United States Patent [19]

Wolter

[11] 4,302,957

[45] Dec. 1, 1981

[54] LOCK CYLINDER

[75] Inventor: Heinz Wolter, Kürten, Fed. Rep. of Germany

[73] Assignee: Dom-Sicherheitstechnik GmbH & Co. KG, Brühl, Fed. Rep. of Germany

[21] Appl. No.: 106,315

[22] Filed: Dec. 21, 1979

[30] Foreign Application Priority Data

Dec. 23, 1978 [DE] Fed. Rep. of Germany ..... 2856006

[51] Int. Cl.[3] ..... E05B 35/08

[52] U.S. Cl. ..... 70/337; 70/364 A

[58] Field of Search ..... 70/337, 364 R, 364 A, 70/DIG. 62

[56] References Cited

U.S. PATENT DOCUMENTS 1,785,634 12/1930 Lawrence ..... 70/337

2,580,882 1/1952 Blohm ..... 70/DIG. 62

3,973,421 8/1976 Patriquin ..... 70/364 R 4,075,879 2/1978 Christopher ..... 70/337

*Primary Examiner*—Robert L. Wolfe

*Attorney, Agent, or Firm*—Martin A. Farber

[57] ABSTRACT

A lock cylinder with a rotatable cylinder core, which cylinder core has the key channel and is rotatable up to fixed abutment positions, the cylinder core being provided with tumbler core pins to which there are coordinated housing pins, the latter being arranged in bores of the cylinder housing. The rotation abutment of the cylinder core is formed by a core pin which is controllable by means of the key, the core pin entering into a slot open in the direction of the core. The base surface of the slot comprises several partial sections which are arranged at different radial distances, each partial section respectively being off-set step-like with respect to each other.

9 Claims, 4 Drawing Figures

Figure 1:
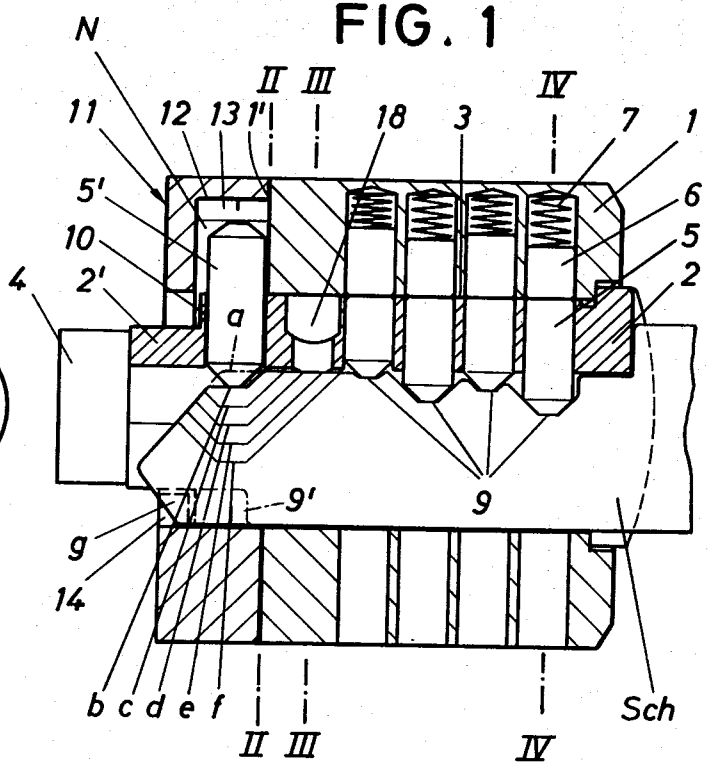

1
6
5
2
7
IV
3
18
III
II
13''
13
12
N
11
5'
10
2'
4
a
9
9'
Sch
IV
III
II
f
e
d
c
b
g
14

N
12
L
I
13
O
5'
P
22'
X
V
13
13
13
14
13
Z
T
Sch
W
8
2
3
24
25
21
11
22
22'
23
23

LOCK CYLINDER

The invention relates to a lock cylinder with a rotatable cylinder core, which cylinder core has the key channel and is rotatable up to fixed abutment positions, the cylinder core being provided with tumbler core pins, coordinated to which are housing pins, the latter being arranged in bores of the cylinder housing.

It is the purpose of the present invention, in particular, to provide a cash register lock with individual pervailingly superordinated key functions.

The invention is based on the task of forming a lock cylinder of this generic type which is simple to produce and of a construction which is dependable in use, such that by means of differently cut keys its core can be brought into rotation angle ranges intended for different functions.

In accordance with the invention, the rotation abutment of the cylinder core is formed by a core pin which is controllable by means of the key, the core pin entering into a slot open in the direction of the core. The base surface of the slot comprises several partial sections which are arranged at different radial distances, each partial section respectively being off-set step-like with respect to each other, the abutment core pin being disposed on a far side of the core tumbler pins relative to an inserstion-side face of the lock cylinder.

As a result of such formation a lock cylinder of the general type has been created of increased serviceability. It can be used wherever a division of functions is provided. There exists a relatively large field of application here, from devices for the control of machines, particularly machine tools, to cash registers in supermarkets, or respectively, cash registers in the hotel industry. The angle of rotation ranges can be individually adjusted to the prevailing program, and indeed, starting with the switching on of such devices up to the function of the technician which may be required for the servicing, which servicing requires a turning of the cylinder core over all intermediate ranges. The construction means are relatively simple in that the respective rotation abutment of the cylinder core is formed by one core pin, the latter being controllable by means of the respective key which is used from time to time.

The core pin which is pushed out by the key by different distances projects into the step-shaped slot. Depending upon how far the pin is pushed out, the latter strikes against a step which is either closer or further away. In this manner in a simple fashion and with retention of the basic concept of such lock cylinders, different rotation angle amounts are brought about, which different rotary angle amounts, via a rotary contact, can be transformed into mechanical, or respectively, electromechanical functions, for example, on a cash register. The graduation is very sensitive and yet is clearly separated.

In the manner that the abutment core pin is located beyond or on the far side of the tumbler core pins, thus practically outside of the cylinder housing, it is even open for visible maintenance. It can be removed at any time, for example in case of possible wear or in case of a new appliance. Practically nothing on the lock cylinder itself is changed, since the means forming the abutment appear as complementary construction parts.

By the constructional measure that a second row of tumbler housing pins is coordinated to at least one intermediate step, on the one hand, unnecessary rotation paths are dispensed with; and on the other hand, a direct series of functions results, for example, in connection with the off-on switching operation.

As a consequence of the additional constructional measure that the partial sections which are step-like off-set with respect to each other constitute the central vicinity of the total range of the angle of rotation of the key, which total range continues in both directions up to the limit abutment of the angle of rotation, there results one rotation angle range which is situated in front of the middle range and one which extends beyond the middle range, each of which rotation angle ranges respectively can be provided with an additional function. These additional rotation angle ranges are realized without the step gap or jump of the slot having to be refined. In order thereby to operationally separate the rotation angle range which is situated in front of the stepped middle area, the correspondingly matching key is provided with a notch on the back side, which notch crosses over the housing abutment there.

The end abutments for the angle of rotation in other cases are formed in simple fashion by the end flanks of a core channel, into which core channel the housing abutment projects. The latter can be formed in an advantageous manner in the form of a bolt.

Finally an advantageous development is that the slot is arranged in a plate, which plate is set against the rear face of the cylinder housing, which plate simultaneously forms the cylinder attachment flange. In order to convert the function program, the plate only needs to be taken off and replaced by a differently programmed plate.

Further advantages and details of the subject matter of the invention are more closely explained in the following by means of an embodiment example shown in an illustration.

Figure 2:
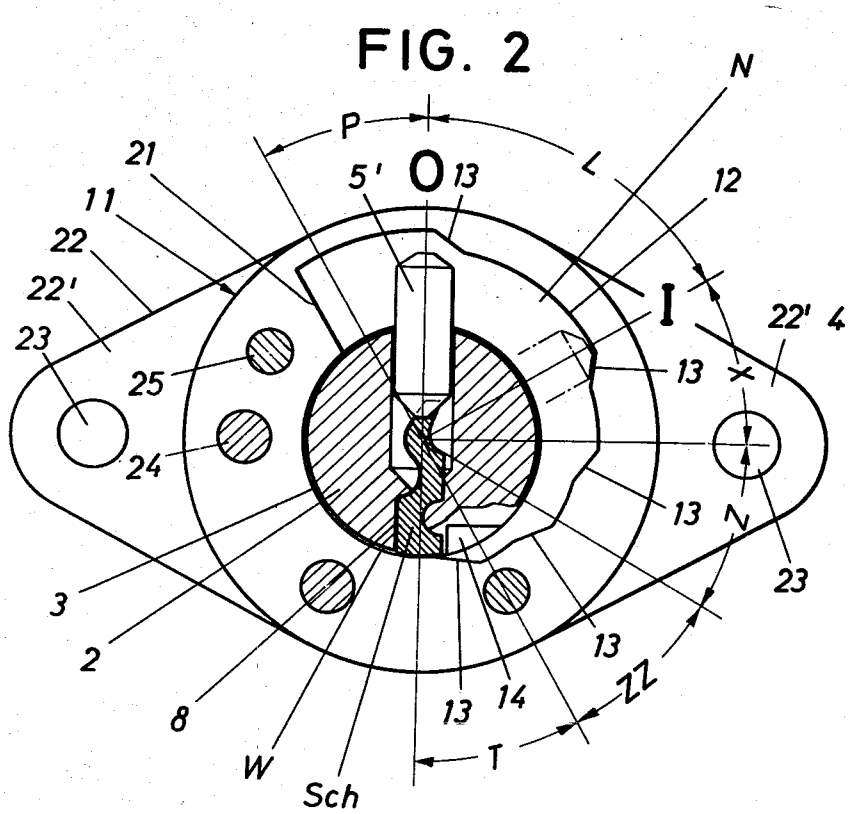
Figure 3:
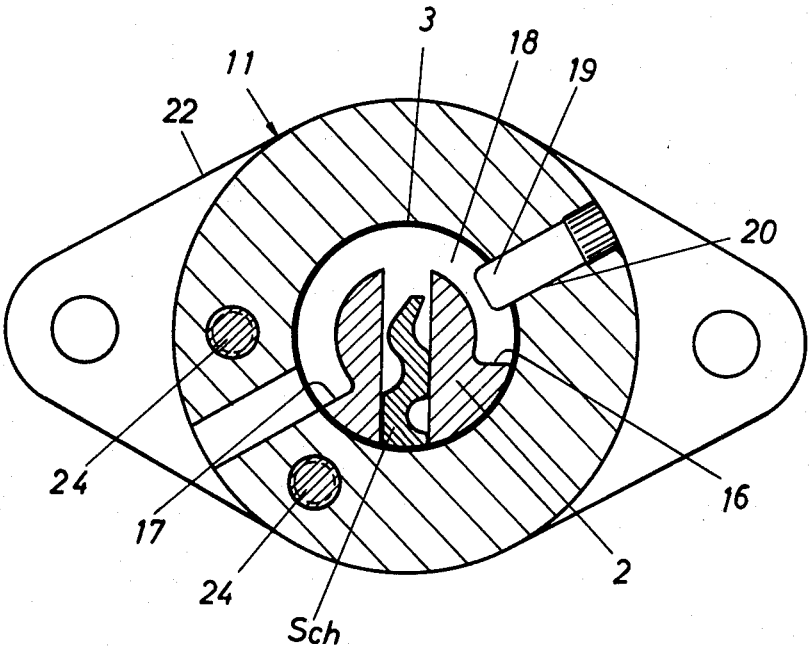
Figure 4:
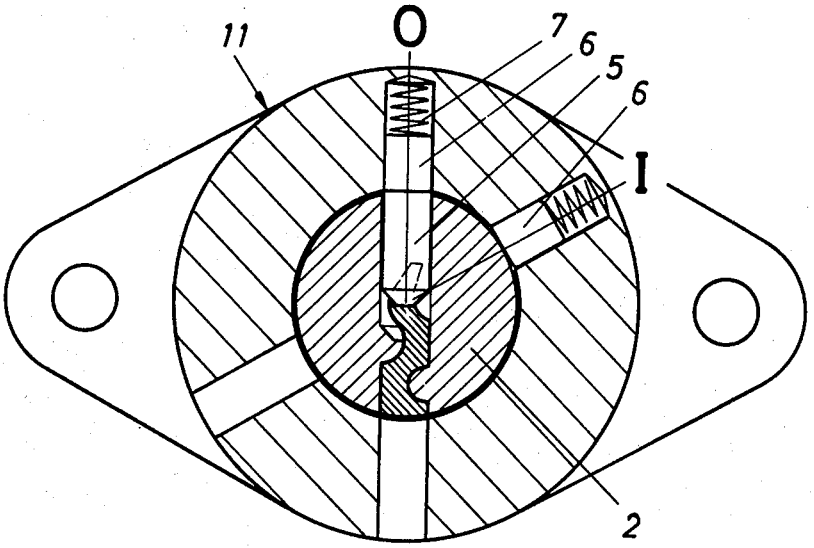

It shows:

FIG. 1 in enlarged scale, the lock cylinder (according to the invention) with key, in which also all keys according to the program are shown, FIG. 2 a section according to line II—II in FIG. 1, FIG. 3 a section according to line III—III in FIG. 1 and FIG. 4 a section according to line IV—IV in FIG. 1.

The illustrated lock cylinder comprises a cylinder housing 1 with a centrally inserted cylinder core 2. Its continuously extending-through reception bore for the core is designated 3. The rearwardly projecting end 2' of the cylinder core 2, which end 2' projects out of the cylinder housing 1 beyond the rear face of the cylinder housing, forms a driver 4. A (not illustrated) contact finger is coordinatable to the latter, which contact finger by electrical or electro-mechanical means actuates the functions or operations which are triggered corresponding to the rotational position of the cylinder core.

The lock cylinder is equipped with four tumbler pins, which tumbler pins in customary fashion comprise core pins 5 and housing pins 6, as well as pin springs 7, which springs pins 7 bias the latter. The core pins 5 projects into the key channel 8. The latter, as can be seen in FIG. 2, is profiled. By means of a corresponding longitudinal dimensioning of the bores (which bores displaceably mount the core pins 5), the core pins 5 obtain an abutment limitation designed such that in the locking position the housing pins blockingly cross the surface of the cylinder core 2.

The cylinder core 2 can be rotated only when the correct key or keys are inserted which with their lock notches 9 displace the tumbler pins 5 such that the separation line of the latter, that is the face surfaces which step against each other, are at the rotation joint of the cylinder core 2. This ready-to-turn normal position is shown in FIG. 1.

The cylinder lock has two key removal positions. These positions are marked O and I. The O-position is in the vertical position; the key removal position I follows in the clockwise direction, after a rotary path of 60 degrees.

Six different keys are coordinated to the illustrated lock cylinder, they are completely formed alike with respect to the profile and the locking notches, but in order to achieve different key rotation paths, are modified in relation to an additional, so-called abutment core pin 5'. This abutment core pin 5' is transversely displaceably mounted in the free end 2' of the cylinder core 2. The bore of the core is designated 10 and is in the plane of the key channel 8. The notches, and respectively, the control flanks of the keys Sch, which notches displace or push out this core pin radially to different extents, are designated a to f. The key having the control flank a providing the largest radial displacement of the core pin 5' is marked by dot-dashed lines with respect to this formation.

The additional core pin 51 which forms the rotation abutment, which rotation abutment is varied depending on the key which is used, projects into the slot N of a plate 11, which plate 11 is positioned against the rear face 1' of the cylinder housing 1. The base surface 12 of the slot N forms rotation paths of the key, in the form of partial sections L, X, Z, ZZ at different radial distances which lie in the step jump or gap of the notches b to f, starting clockwise from the removal position O. These partial sections L to ZZ are step-like off-set relative to each other. The corresponding steps have the reference numeral 13. The individual steps are formed as run-up inclinations corresponding to the frustoconically-shaped head zone of the abutment core pin 5'. The first partial section L, as mentioned, is based on a rotary path of 60 degrees. The key with the ntoch b is coordinated to the first partial section L. With use of the lock cylinder on a cash register, this key would be used as a so-called operator key. The key is removable at the end of the rotation path provided for it, since a second tumbler pin housing row is coordinated to this intermediate step 13 (compare FIG. 4). The reverse rotation in the key removal position O is limited by a housing-sided projection 14, against which projection the part on the back side of the key abuts. An exception is made only in the case of the key with the control flank a, as will be explained below.

The partial section X which follows the partial section L can only be traversed with the use of a key Sch having the notch c. This partial section marked X has a rotational path of 30 degrees. This range is intended for the named use for the reading function.

The next-following partial section Z likewise includes a rotational path of 30 degrees and can be used as an additional superordinated function of emptying the register memory. The corresponding key is the one with the notch d. The succeeding partial section ZZ, also, provides for a 30 degree rotary movement of the key. The corresponding key is the one with the notch e. The rotational path of the latter key is limited by the last of the steps 13. This step runs out or exits onto the bore wall W of the plate 11. The bore wall W extends coaxially aligned flush relative to the reception bore 3 of the cylinder core 2.

The key which is suitable for the partial section ZZ can be provided for the complete emptying of the register or memory.

Additionally a partial section P is arranged in front and a partial section T is arranged behind the explained central range, which central range comprises the partial sections L-ZZ, which are off-set step-like relative to each other. The rotary paths of the key each amount to 30 degrees. The movement is limited by rotation angle end abutments 16 and respectively 17. The abutments are formed by the end flanks of a core channel 18. The core channel extends transversely to the axis of rotation of the cylinder core 2. A housing abutment 19 projects into the channel 18. The abutment 19 is realized in the form of a bolt, which bolt is driven into a correspondingly tranversely directed bore 20, the bolt projecting beyond the rotation joint between the cylinder core 2 and the cylinder housing 1. The cross-section of the bolt approximately corresponds to the width of the channel, so that this bolt constitutes an effective removal safeguard for the cylinder core 2, which safeguard unloads the tumbler pins and even the abutment core pin 5', the latter running in rear of the front face 1' of the housing 1.

The matching key Sch for the partial section P (which partial section P is disposed in front of the partial section L) can be turned from the key removal position O only in the counterclockwise direction. This key, which in FIG. 1 forms the contour and control flank a, respectively, shown in dot-dashed lines, can be a so-called program key. The end flank (the rotational angle limit abutment 16), which is responsible for the left side rotation limitation, strikes against the fixed housing abutment 19 even before the abutment-core tumbler pin 5' is able to strike against this front face 21 of the slot, which abutment core tumbler pin 5' in this position is displaced outwardly relatively far out of its core bore 10. Consequently this core pin, in the condition of its reduced radial support, is not loaded in the sense of a bending or the like.

In order for the key Sch, which is appropriate for the partial section P, to be able to be actuated counterclockwise, differently from all other keys beyond the key removal position O, this key in the vicinity of the projection 14 (the latter being fixed to the plate 11) has a matching notch 9' on the rear side so that this key can travel over the projection. A clockwise turning of the key is prevented by means of the first step 13.

The key for the additional partial section (T), which partial section (T) is disposed after the stepped central range (L to ZZ) has the deepest cut notch f. This key, providing a so-called technician's function, runs through all intermediate steps and is reserved for servicing. The additional function however can only take place when the program key, also has been handed to the service person, so that here too the possibility of control remains.

The core channel 18 is provided in a free zone between the last tumbler pin and the abutment core pin 5'. The step gap or jump of the slot N respectively under the circumstances amounts approximately to 0.5 mm.

The plate 11 forms a flange 22. The flange lugs 22', which project over the cross section of the plate extend transversely to the key removal position O. They have openings 23 for the attachment means. Tightening or check screws 24 serving for the attachment of the exchangeable and therefore easily recordable plate 11, which pass through entrance openings of the plate 11, can be screwed into congruent threaded bores of the cylinder housing. In order to achieve an exact coordination of the cylinder housing 1 and the plate 11, adjusting pins 25 can be additionally provided. The latter advantageously are located in the cylinder housing 1 and enter into matching holes of the plate 11.

I claim:

1. A lock cylinder, comprising a cylinder housing formed with bores and with rotation angle limit abutment means, a row of housing tumbler pins disposed in said bores of the housing, a rotatable cylinder core is rotatably disposed in said cylinder housing, said cylinder core defining a key channel, said abutment means for limiting the rotation of said cylinder core in said housing defining fixed abutment positions, said cylinder housing defines a key insertion-side face and a rear face therebehind in an axial direction of said cylinder core, said cylinder core projects beyond said rear face of said cylinder housing forming a rearwardly projecting end of said cylinder core, tumbler core pins disposed in said cylinder core and which operatively are coordinated to said housing tumbler pins, only one abutment core pin is disposed in said rearwardly projecting end of said cylinder core and controllable by one of a plurality of keys, respectively, inserted in the key channel, said keys are formed with different depth notches, respectively, cooperating with said abutment core pin, said core pin constituting means for providing various rotation angle limit abutments for the cylinder core, a housing-sided slot means forming a single slot for receiving said core pin therein, said slot means has a base surface and is open in the direction of the core, said base surface of said slot means comprises a plurality of partial sections which are arranged at different radial distances relative to said cylinder core, each of said partial sections respectively being off-set and connected via steps with respect to each other and each of said steps cooperates with said core pin selectively depending on said one key formed with one of said different depth notches, respectively.

2. The lock cylinder according to claim 1, further comprising said partial sections defining intermediate said, a second row of housing tumbler pins disposed at an angle relative to said first mentioned housing tumbler pins, is coordinated to at least one of said intermediate steps.

3. The lock cylinder according to claim 1, wherein said partial sections constitute a central vicinity of a total range of angle of rotation of the key, said total range continues in both directions of rotation up to the rotation angle limit abutment means.

4. The lock cylinder according to claim 3, wherein said rotation angle limit abutment means constitutes, said cylinder core being formed with a core channel having abutment end flanks of the core channel, a housing abutment projecting from said cylinder housing into said core channel, said housing abutment is arranged so as to be spaced from and traveled over by the key and abuttingly cooperates with said end flanks, respectively, defining said fixed abutment positions.

5. The lock cylinder according to claim 1, wherein said slot means comprises a plate mounted against the rear face of said cylinder housing and forms said slot thereon.

6. The lock cylinder according to claim 5, wherein said plate simultaneously is formed with a cylinder attachment flange means for attachment to said cylinder housing at said rear face.

7. The lock cylinder according to claims 1 or 4, wherein said rotation angle limit abutment means is disposed at said cylinder housing in an end portion thereof adjacent said rear face behind said tumbler pins between the latter and said rear face, all said different depth notches being spaced completely apart from said core tumbler pins by said end portion of said cylinder housing.

8. The lock cylinder according to claim 1 in combination with the key, wherein said different depth notches are formed adjacent the free tip of said keys, respectively.

9. The lock cylinder according to claim 8, wherein the key is formed with a rear notch, the latter constitutes means for permitting rotation of the cylinder core in a direction of rotation opposite to the direction toward said partial sections, said rear notch is formed on one of said keys adjacent the tip thereof on an edge of said one key opposite said different depth notches, said slot means is formed with a projection adjacent said partial section with a smallest of the different radial distances, said projection passes freely through said rear notch.

* * * * *